US006250948B1

(12) United States Patent
Daoud

(10) Patent No.: US 6,250,948 B1
(45) Date of Patent: Jun. 26, 2001

(54) CYLINDRICAL FRONT ACCESS CONNECTOR

(75) Inventor: Bassel Hage Daoud, Parsippany, NJ (US)

(73) Assignee: Avava Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/494,429

(22) Filed: Jan. 31, 2000

(51) Int. Cl.[7] ..... H01R 4/24
(52) U.S. Cl. ..... 439/409; 439/789
(58) Field of Search ..... 439/409, 410, 439/789, 790

(56) References Cited

U.S. PATENT DOCUMENTS

| | | | | |
|---|---|---|---|---|
| 4,153,322 | * | 5/1979 | Godfrey | 339/95 |
| 4,793,823 | * | 12/1988 | Cozzens et al. | 439/409 |
| 4,795,363 | * | 1/1989 | Scherer et al. | 439/395 |
| 5,417,583 | * | 5/1995 | Ishizaki et al. | 439/409 |
| 6,080,006 | * | 6/2000 | Broder | 439/409 |

FOREIGN PATENT DOCUMENTS

| | | | | |
|---|---|---|---|---|
| 198401 | * | 1/1984 | (EP) | 439/409 |

* cited by examiner

*Primary Examiner*—Tulsidas Patel
*Assistant Examiner*—Thanh-Tam Le

(57) ABSTRACT

An electrical connector includes a base, a connector housing supported by the base, and at least one conductive terminal received within the connector housing. The conductive terminal includes a keyhole slot therein including a circular aperture and an elongated slot extending therefrom. The connector housing includes a handle having at least one wire-receiving passage therein, and is movable between a first position and a second position. An insulated wire is readily insertable and removable through the wire-receiving passage in the handle and the circular aperture in the conductive terminal when the connector housing is in the first position. When the connector housing is moved to the second position, the wire is moved from the circular aperture and forced into the elongated slot. The elongated slot constricts the wire and pierces the insulation of the wire, thereby establishing electrical contact between the conductor of the wire and the conductive terminal, and restricting removal of the wire from the connector housing. The connector housing may include one or more separate terminals therein for receiving one or more wires therein. The base may be formed as a panel having a plurality of housing receiving portions, with a plurality of electrical connectors arranged in the plurality of housing receiving portions to form an array of electrical connectors.

20 Claims, 6 Drawing Sheets

CYLINDRICAL FRONT ACCESS CONNECTOR

BACKGROUND OF THE INVENTION

1. Field of the Invention

The present invention relates to an electrical connector, and more particularly, to an insulation displacement connector which pierces through an insulation layer of an insulated wire to establish electrical contact between the conductor of the wire and a conductive terminal of the connector.

2. Description of the Background Art

Various types of connectors are known for interconnecting with wires having conductors surrounded by an insulating layer. One type of connector is known as an insulation displacement connector, with which an electrical connection can be achieved without stripping away the insulation from the wire. A typical insulation displacement connector includes a generally flat conductive terminal having a slot therein which receives an insulated wire. Sharpened edges along the slot sever the insulation as the wire slides along the slot, thereby establishing an electrical connection between the terminal and the conductor of the wire, without necessitating the pre-stripping of the insulation from the wire.

In one style of insulation displacement connector, the wire is inserted, for example, into the connector from one side thereof until the wire is overlying the slot of the terminal. A large force is then applied, for example, downwardly and orthogonally to the direction of insertion of the wire, in order to force the wire into the slot between the blades of the terminal.

Unfortunately, with this style of insulation displacement connector, it is necessary to have clearance on both the side and the top of the connector in order to accommodate insertion of the wire into the connector, and subsequent insertion of the wire onto the terminal. Further, the large forces required to force the wire into the slot can dislodge the terminal from securement within the connector, since typically the terminal is inserted into the connector during manufacture in the same direction as the forces applied to the terminal during the forcing of the wire into the slot.

There is a need in the art for an insulation displacement connector which requires a minimum of clearance space therearound so that more connectors may be accommodated within a given space. Further, there is a need for an insulation displacement connector which is not susceptible to dislodging of the terminal under the forces applied to the terminal during insertion of the wire into the slot of the terminal.

SUMMARY OF THE INVENTION

The present invention fulfills the aforementioned need in the art by providing an electrical connector which includes a base, a connector housing supported by the base, and at least one conductive terminal received within the connector housing. The conductive terminal includes a keyhole slot therein including a circular aperture and an elongated slot extending therefrom. The connector housing includes a handle having at least one wire-receiving passage therein, and is movable between a first position and a second position. An insulated wire is readily insertable and removable through the wire-receiving passage in the handle and the circular aperture in the conductive terminal when the connector housing is in the first position. When the connector housing is moved to the second position, the wire is moved from the circular aperture and forced into the elongated slot. The elongated slot constricts the wire and pierces the insulation of the wire, thereby establishing electrical contact between the conductor of the wire and the conductive terminal, and restricting removal of the wire from the connector housing. The connector housing may include one or more separate terminals therein for receiving one or more wires therein. The base may be formed as a panel having a plurality of housing receiving portions, with a plurality of electrical connectors arranged in the plurality of housing receiving portions to form an array of electrical connectors.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
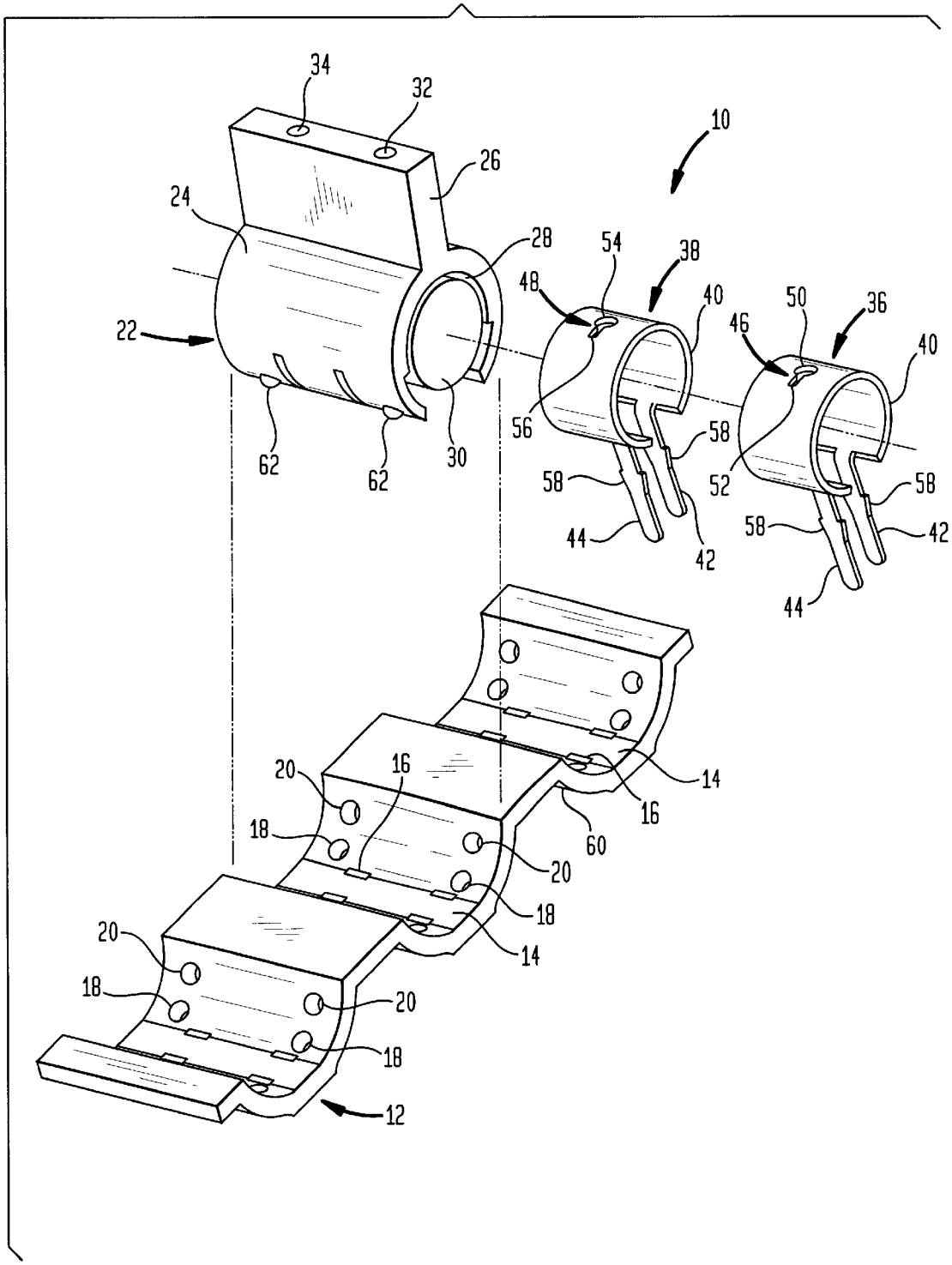
FIG. 1 is an exploded perspective view of a connector according to the present invention.

Referring in detail to the drawings, and with particular reference to FIG. 1, a connector 10 of the present invention is shown. The electrical connector 10 includes a base 12 having one or more connector housing receiving portions 14 therein. The base 12 includes a plurality of rectangular apertures 16 extending therethrough, although various other shapes of apertures, such as circular, may be used. A plurality of first indentations or apertures 18 are formed in the base 12, as well as a plurality of second indentations or apertures 20, for reasons which will be explained in detail hereafter.

A connector housing 22 is received within and supported by one of the connector housing receiving portions 14 of the base 12. The connector housing 22 includes a cylindrical body 24 having a handle 26 extending therefrom. A cylindrical groove 28 is formed in the connector housing, such that a cylindrical support member 30 is formed. The connector housing 22 includes a first wire-receiving passage 32 and a second wire-receiving passage 34 therein which extend through the handle 26 and partially through the cylindrical support member 30 of the connector housing 22. The base 12 and the connector housing 22 are formed of a non-conductive material, for example, plastic.

A first conductive terminal 36 and a second conductive terminal 38 are arranged partially within the connector housing 22. The first conductive terminal 36 and the second conductive terminal 38 are identical, so a description will be made with respect to the first conductive terminal 36, with the understanding that the description applies equally to the second conductive terminal 38.

The first conductive terminal 36 includes a cylindrical main body portion 40 having a first prong 42 and a second prong 44 extending therefrom. The cylindrical main body portion 40 is received within the cylindrical groove 28 in the connector housing 22, such that the cylindrical main body portion 40 surrounds and is supported by the cylindrical support member 30 of the connector housing 22.

The cylindrical main body portion 40 of the first conductive terminal 36 includes a wire-receiving aperture 46 therein in the shape of a keyhole slot 48. The wire-receiving aperture 46 includes a wire-passing portion 50 and a constricted portion 52. In a preferred embodiment, the wire-passing portion 50 is formed as a circular aperture 54, and the constricted portion 52 is formed as an elongated slot 56 extending from the circular aperture 54. The elongated slot 56 may include sharpened edges for penetrating wire insulation as described hereafter.

Figure 2:
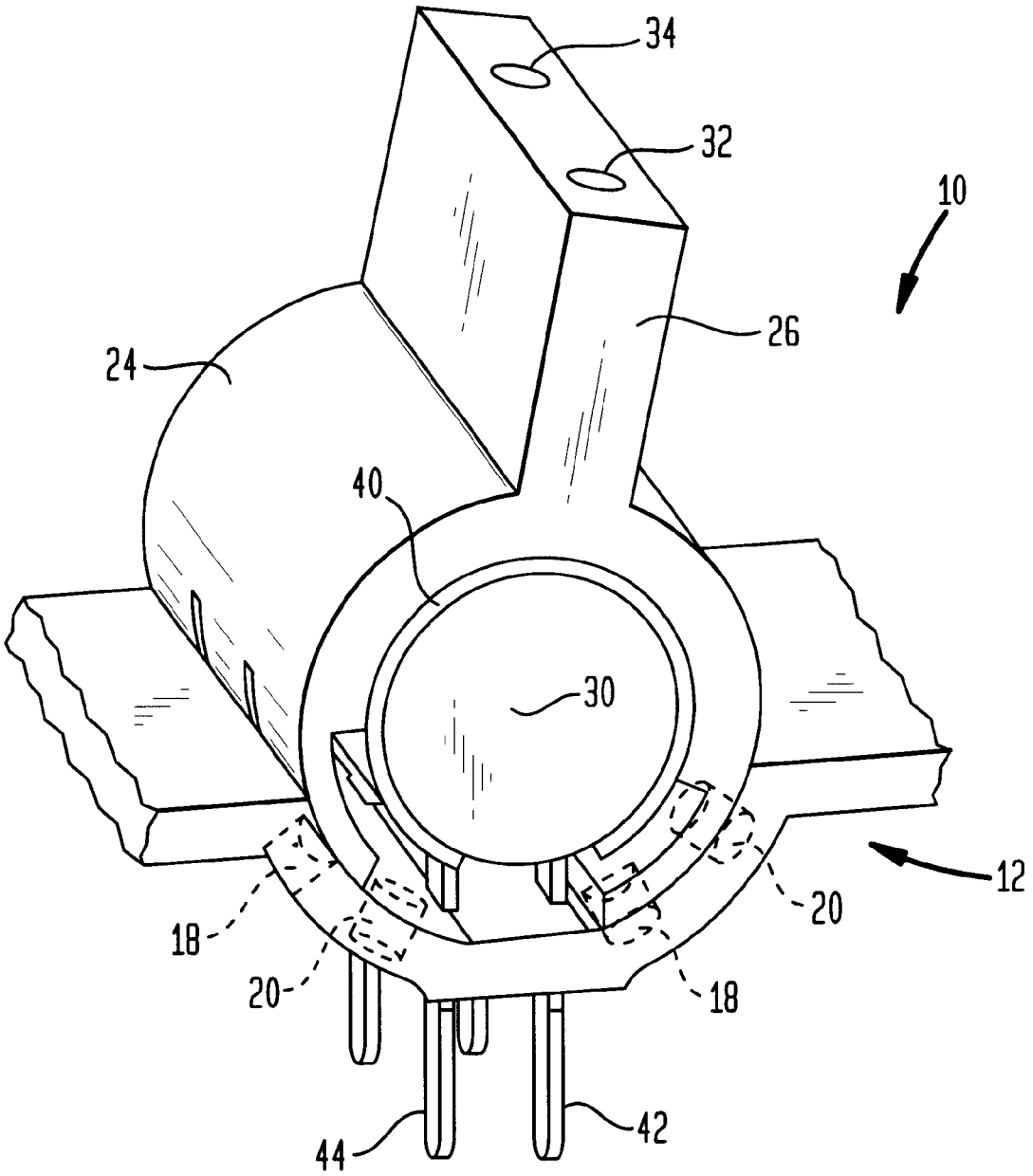
FIG. 2 is a perspective view of the connector in an assembled condition.
Figure 4:
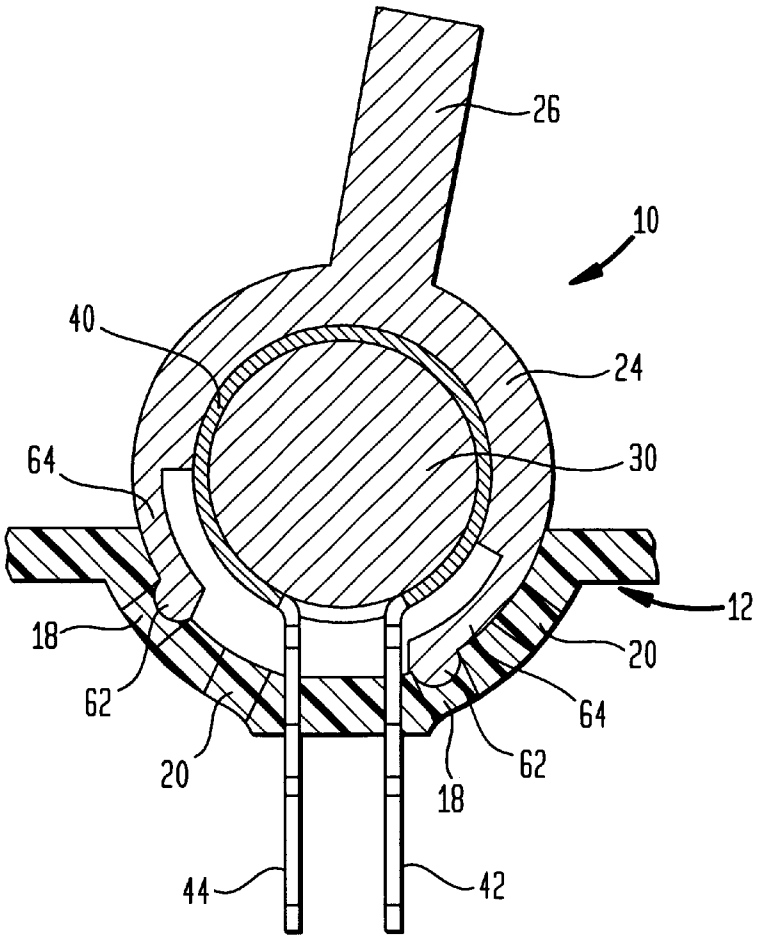
FIG. 4 is a cross-sectional view through the connector of FIG. 2.

Referring now to FIGS. 1 and 2, the electrical connector 10 is assembled by placing the first and second conductive terminals 36,38 into the cylindrical groove 28 formed in the connector housing 22, and passing the first and second prongs 42,44 of the conductive terminals 36,38 though the rectangular apertures 16 in the base 12. A plurality of barbs 58 are located on the first and second prongs 42,44 which hook under a lower surface 60 of the base 12 to retain the first and second prongs 42,44 to the base 12. In this way, the first and second conductive terminals 36,38 and the connector housing 22 are securely fastened to the base 12.

Figure 3:
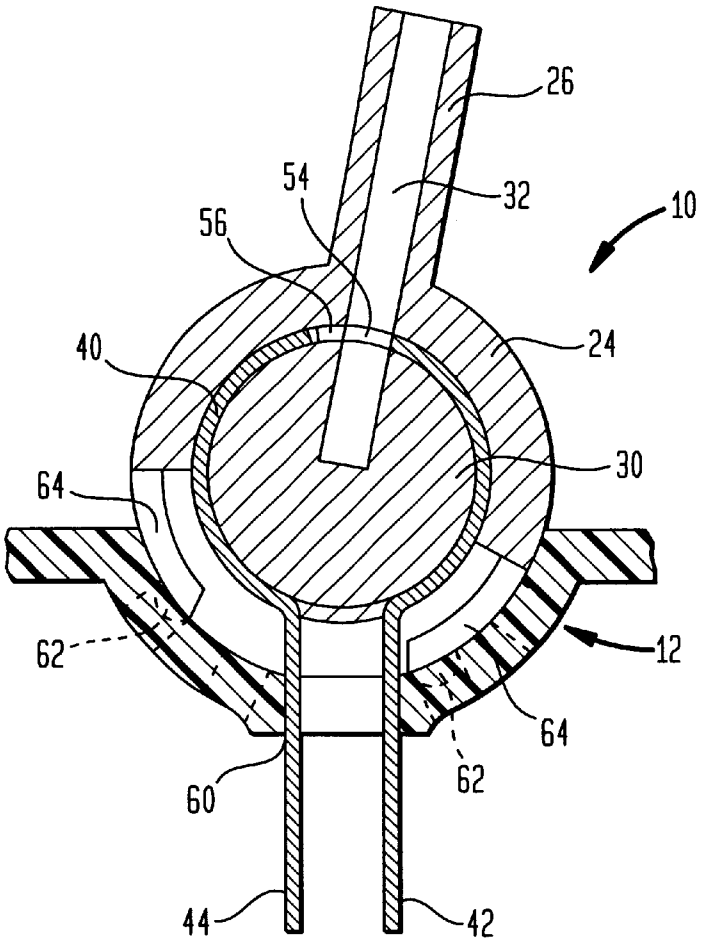
FIG. 3 is a cross-sectional view through the connector of FIG. 2.

The connector housing 22 is movable from a first position shown in FIG. 3 where the first and second wire-receiving passages 32,34 of the connector housing 22 are aligned with the wire-passing portions 50 of the first and second conductive terminals 36,38, and a second position where the first and second wire-receiving passages 32,34 of the connector housing 22 are aligned with the constricted portions 52 of the first and second conductive terminals 36,38.

A plurality of protuberances 62 are located on deflectable leaf members 64 of the connector housing 22. The protuberances 62 are received within the first indentations 18 when the connector housing 22 is in the first position, in order to retain the connector housing 22 in the first position. The protuberances 62 are received within the second indentations 20 when the connector housing 22 is in the second position, in order to retain the connector housing 22 in the second position. The deflectable leaf members 64 bias the protuberances 62 into the first and second indentations 18,20 to positively locate the connector housing 22 in the first and second positions.

When the connector housing 22 is in the first position, a first wire including a conductor surrounded by insulation is inserted through the first wire-receiving passage 32 of the connector housing 22 and through the wire-passing portion 50 of the first conductive terminal 36. Also, a second wire is inserted through the second wire-receiving passage 34 of the connector housing 22 and the wire-passing portion 50 of the second conductive terminal 38. Thereafter, the connector housing 22 is moved to the second position to force the first wire from the wire-passing portion 50 of the first conductive terminal 36 into the constricted portion 52 of the first conductive terminal 36, to thereby pierce the insulation of the first wire and establish electrical contact between the conductor of the first wire and the first conductive terminal 36, and to simultaneously force the second wire from the wire-passing portion 50 of the second conductive terminal 38 into the constricted portion 52 of the second conductive terminal 38, to thereby pierce the insulation of the second wire and establish electrical contact between the conductor of the second wire and the second conductive terminal 38.

Figure 5:
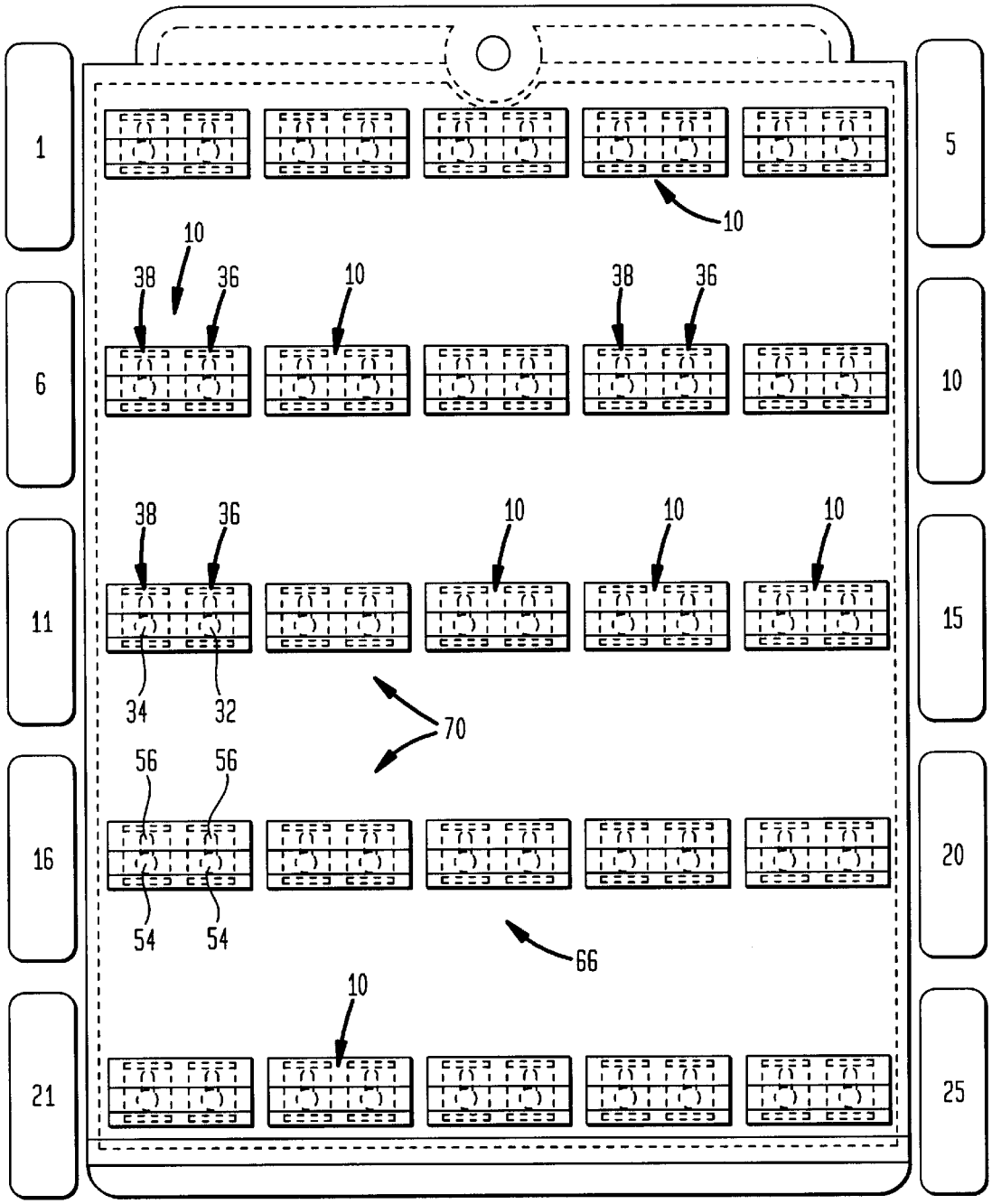
FIG. 5 is a front view of an array of connectors on a connector panel.
Figure 6:
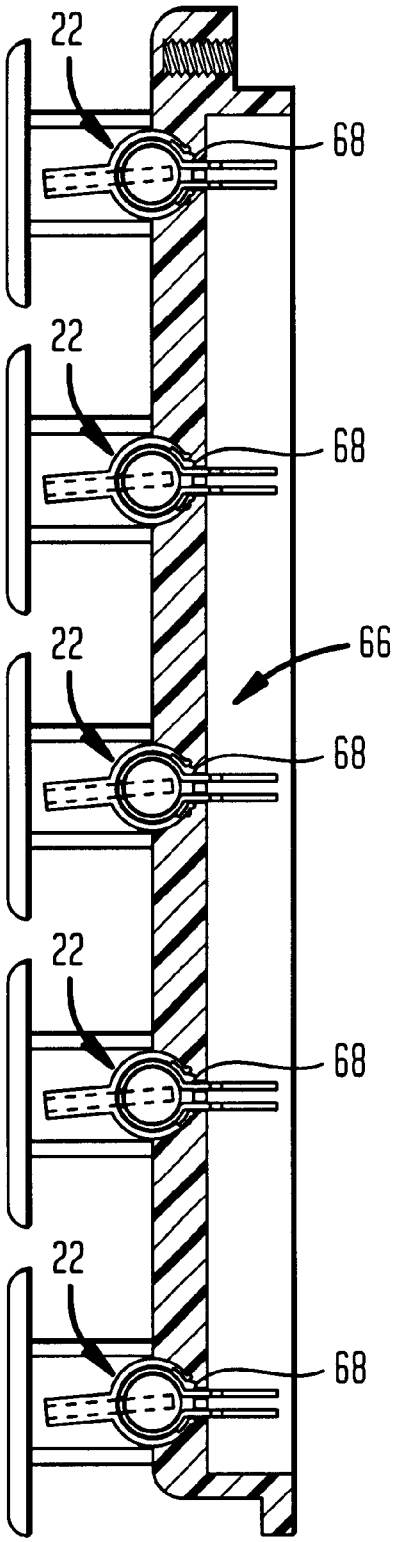
FIG. 6 is a side view of the connector panel of FIG. 5.
Figure 7:
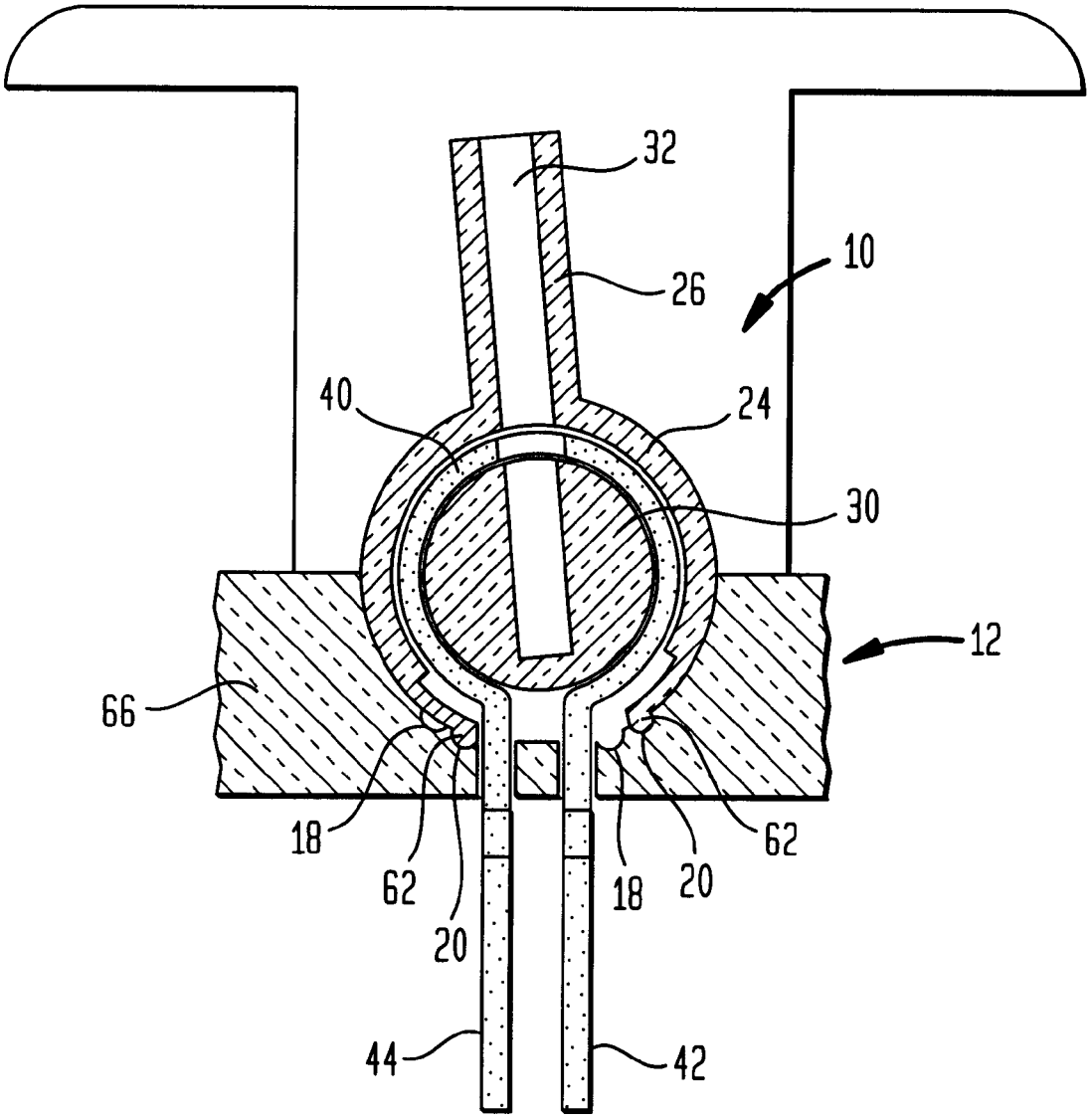
FIG. 7 is a cross-sectional view through the connector and connector panel of FIGS. 5 and 6.

As shown in FIGS. 5–7, the base 12 may comprise a panel 66 having a plurality of housing receiving portions 68 therein. A plurality of the electrical connectors 10 are arranged in the plurality of housing receiving portions 68, to form an electrical connector array 70.

Various alternative arrangements may be made to the present invention. For example, although two conductive terminals are shown in the preferred embodiment, the present invention can be practiced with a single conductive terminal, or with more than two conductive terminals. More than one keyhole slot may be formed in the conductive terminal if it is desired to connect more than one wire to the same conductive terminal. Although two prongs are shown per conductive terminal in the preferred embodiment, the invention can be practiced with only one prong, or with three, four or more prongs per conductive terminal. Although four protuberances are shown on the connector housing, the invention may be practiced with more or fewer protuberances, for example, one protuberance may be sufficient to retain the connector housing in each of the two positions. Also, the protuberances may instead be located on the base, and the indentations located in the connector housing. Although the wire-receiving aperture in the conductive terminal is preferably formed as a keyhole shape, other shapes of wire-receiving apertures may be utilized which provide a first portion which allows the insulated wire to pass therethrough, and a second portion which constricts the wire and strips through the insulation layer.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An electrical connector comprising:

a base having a first indentation therein and a second indentation therein;

a connector housing supported by said base and movable between a first position and a second position, said connector housing including a first deflectable leaf member extending therefrom, said first deflectable leaf member including a protuberance thereon, said protuberance being biased into said first indentation by said first deflectable leaf member when said connector housing is in said first position, and said protuberance being biased into said second indentation by said first deflectable leaf member when said connector housing is in said second position, said connector housing further including a wire-receiving passage therein; and a conductive terminal, said conductive terminal including a main body portion received within said connector housing, said main body portion including a wire-receiving aperture therein, said wire-receiving aperture including a wire-passing portion and a constricted portion.

2. The electrical connector according to claim 1, wherein said wire-receiving aperture comprises a keyhole slot including a circular aperture and an elongated slot extending from said circular aperture, said circular aperture forming said wire-passing portion, and said elongated slot forming said constricted portion.

3. The electrical connector according to claim 1, wherein said wire-receiving passage of said connector housing is aligned with said wire-passing portion of said conductive terminal when said connector housing is in said first position, and said wire-receiving passage of said connector housing is aligned with said constricted portion of said conductive terminal when said connector housing is in said second position.

4. The electrical connector according to claim 3, wherein a wire including a conductor surrounded by insulation is insertable through said wire-receiving passage and said wire-passing portion when said connector housing is in said first position, and said connector housing is movable to said second position to force said wire from said wire-passing portion into said constricted portion, to thereby pierce the insulation of the wire and establish electrical contact between the conductor of the wire and the conductive terminal.

5. The electrical connector according to claim 1, further comprising a second deflectable leaf member extending from said connector housing such that a portion of said conductive terminal is located between said first deflectable leaf member and said second deflectable leaf member, said second deflectable leaf member having a second protuberance thereon, and a third indentation located in said base for receiving said second protuberance therein when said connector housing is in said first position.

6. The electrical connector according to claim 5, further comprising a fourth indentation located in said base for receiving said second protuberance therein when said connector housing is in said second position.

7. The electrical connector according to claim 1, further comprising a groove located within said connector housing for receiving said main body portion of said conductive terminal therein.

8. The electrical connector according to claim 1, further comprising a handle extending from said connector housing.

9. The electrical connector according to claim 8, wherein said wire-receiving passage extends through said handle.

10. The electrical connector according to claim 1, further comprising.

a first prong extending from said main body portion of said conductive terminal; and a first aperture located in said base for passage of said first prong therethrough.

11. The electrical connector according to claim 10, further comprising at least one barb located along said first prong for retaining said first prong to said base.

12. The electrical connector according to claim 10, further comprising a second prong extending from said main body portion of said conductive terminal.

13. The electrical connector according to claim 1, wherein a portion of said main body portion of said conductive terminal is cylindrical.

14. The electrical connector according to claim 1, further comprising:

a handle extending from said connector housing, said wire-receiving passage extending through said handle; and said wire-receiving aperture comprising a keyhole slot including a circular aperture and an elongated slot extending from said circular aperture, said circular aperture forming said wire-passing portion, and said elongated slot forming said constricted portion, wherein said wire-receiving passage of said connector housing is aligned with said wire-passing portion of said conductive terminal when said connector housing is in said first position, and said wire-receiving passage of said connector housing is aligned with said constricted portion of said conductive terminal when said connector housing is in said second position.

15. The electrical connector according to claim 14, further comprising:

a first prong extending from said main body portion of said conductive terminal;

a second prong extending from said main body portion of said conductive terminal;

a first barb located along said first prong for retaining said first prong to said base; and a second barb located along said second prong for retaining said second prong to said base.

16. The electrical connector according to claim 15, further comprising a groove located within said connector housing for receiving said main body portion of said conductive terminal therein, wherein a portion of said main body portion of said conductive erminal is cylindrical.

17. An electrical connector comprising:

a base having a first indentation therein and a second indentation therein;

a connector housing supported by said base and movable between a first position and a second position, said connector housing including a deflectable leaf member extending therefrom, said deflectable leaf member including a protuberance thereon, said protuberance being biased into said first indentation by said deflectable leaf member when said connector housing is in said first position, and said protuberance being biased into said second indentation by said deflectable leaf member when said connector housing is in said second position, said connector housing further including a first wire-receiving passage and a second wire-receiving passage therein; and a first conductive terminal and a second conductive terminal, each of said first and second conductive terminals including a main body portion received within said connector housing, each said main body portion including a wire-receiving aperture therein, each said wire-receiving aperture including a wire-passing portion and a constricted portion, wherein said first wire-receiving passage of said connector housing is aligned with said wire-passing portion of said first conductive terminal and said second wire-receiving passage of said connector housing is aligned with said wire-passing portion of said second conductive terminal when said connector housing is in said first position, and said first wire-receiving passage of said connector housing is aligned with said constricted portion of said first conductive terminal and said second wire-receiving passage of said connector housing is aligned with said constricted portion of said second conductive terminal when said connector housing is in said second position.

18. The electrical connector according to claim 17, further comprising:

a handle extending from said connector housing, said first and second wire-receiving passages extending through said handle;

said first and second conductive terminals each including a prong extending from said main body portion;

a first aperture located in said base for passage of said prong of said first conductive terminal therethrough; and a second aperture located in said base for passage of said prong of said second conductive terminal therethrough.

19. The electrical connector according to claim 17, wherein a first wire including a conductor surrounded by insulation is insertable through said first wire-receiving passage and said wire-passing portion of said first conductive terminal when said connector housing is in said first position, and a second wire including a conductor surrounded by insulation is insertable through said second wire-receiving passage and said wire-passing portion of said second conductive terminal when said connector housing is in said first position, and wherein said connector housing is movable to said second position to force said first wire from said wire-passing portion of said first conductive terminal into said constricted portion of said first conductive terminal, to thereby pierce the insulation of the first wire and establish electrical contact between the conductor of the first wire and the first conductive terminal, and to simultaneously force said second wire from said wire-passing portion of said second conductive terminal into said constricted portion of said second conductive terminal, to thereby pierce the insulation of the second wire and establish electrical contact between the conductor of the second wire and the second conductive terminal.

20. An electrical connector array comprising:

a base comprising a panel having a plurality of housing receiving portions, each of said housing receiving portions having a first indentation therein and a second indentation therein, and a plurality of said electrical connectors arranged in said plurality of housing receiving portions, each of said electrical connectors comprising:

a connector housing supported by said base and movable between a first position and a second position, said connector housing including a deflectable leaf member extending therefrom, said deflectable leaf member including a protuberance thereon, said protuberance being biased into said first indentation by said deflectable leaf member when said connector housing is in said first position, and said protuberance being biased into said second indentation by said deflectable leaf member when said connector housing is in said second position, said connector housing further including a wire-receiving passage therein; and a conductive terminal, said conductive terminal including a main body portion received within said connector housing, said main body portion including a wire-receiving aperture therein, said wire-receiving aperture including a wire-passing portion and a constricted portion, wherein said wire-receiving passage of said connector housing is aligned with said wire-passing portion of said conductive terminal when said connector housing is in said first position, and said wire-receiving passage of said connector housing is aligned with said constricted portion of said conductive terminal when said connector housing is in said second position.

* * * * *